United States Patent [19]

Simko

[11] 4,197,890

[45] Apr. 15, 1980

[54] INSULATING JACKET FOR BOTTLES

[76] Inventor: James F. Simko, 620 E. Lincoln, Royal Oak, Mich. 48067

[21] Appl. No.: 970,621

[22] Filed: Dec. 18, 1978

[51] Int. Cl.[2] ..... B65D 23/08

[52] U.S. Cl. ..... 150/2.2; 62/372; 150/52 R; 215/13 R

[58] Field of Search ..... 150/2.1, 2.2, 52 F, 150/52 R; 215/12 R, 12 A, 13 R; 62/457, 372; 220/410, 411, 470, 403

[56] References Cited

U.S. PATENT DOCUMENTS

| | | | |
|---|---|---|---|
| 1,949,677 | 3/1934 | Crawford | 215/13 R UX |
| 2,035,384 | 3/1936 | Hinchliff | 150/52 R |
| 2,068,384 | 1/1937 | Newport | 62/372 |
| 2,216,330 | 10/1940 | Stover | 62/372 |
| 2,482,322 | 9/1949 | Cortese | 215/12 R |
| 2,522,381 | 9/1950 | Kramer | 150/52 R |
| 2,647,595 | 8/1953 | Meyers | 150/52 R X |
| 2,974,814 | 3/1961 | Parsons | 215/13 R |

FOREIGN PATENT DOCUMENTS

| | | | |
|---|---|---|---|
| 358916 | 1/1962 | Switzerland | 215/12 R |

*Primary Examiner*—Donald F. Norton

*Attorney, Agent, or Firm*—Barnes, Kisselle, Raisch & Choate

[57] ABSTRACT

An insulation jacket for beverage bottles which includes a cylindrical wrapper of thin flexible insulating material shaped to fit a bottle combined with one or more elastic elongate inserts to permit the wrapper to adjust to various diameters and also fit snugly around a bottle. Top and bottom closures are provided together with a space for a disc-like refrigerant pack to supply a concentrated source of cold to maintain the desired low temperature within the jacket.

6 Claims, 7 Drawing Figures

INSULATING JACKET FOR BOTTLES

FIELD OF INVENTION

Insulation of Beverage Containers

BACKGROUND OF THE INVENTION

Many devices have been used to maintain low temperatures in liquid containers. Canteens with canvas jackets which were dampened to achieve the cooling effect of evaporation have been used. The present invention relates to an insulating jacket tailored to a wine bottle shape and provided with top and bottom closure devices to insure full insulation effect. A further object of the invention lies in the introduction of elastic insulating inserts which insure a snug fit around a bottle as well as rendering it adaptable to varying sizes.

Other objects of the invention will be apparent as the following description unfolds with details of shape and construction.

BRIEF DESCRIPTION OF THE DRAWINGS

DRAWINGS accompany the disclosure and the various views thereof may be briefly described as.

Figure 1:
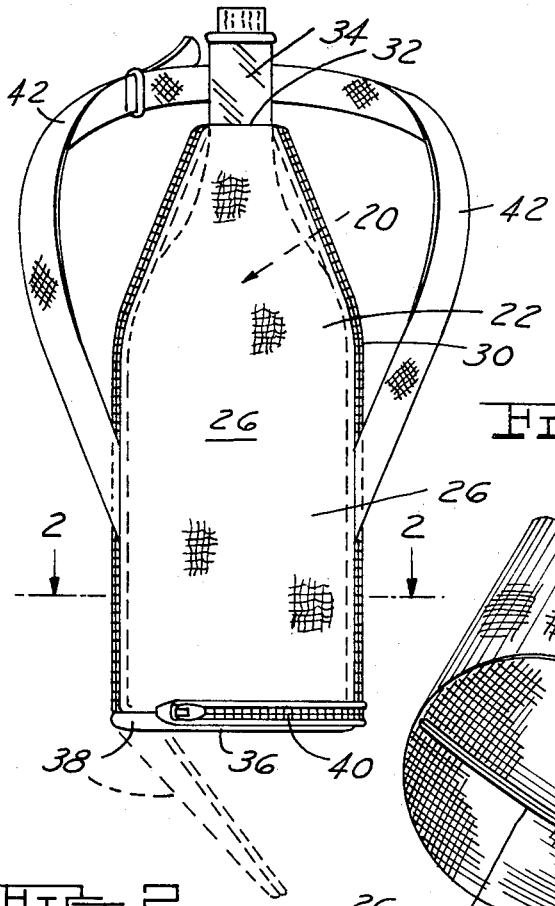
FIG. 1, an elevation of a bottle jacket.
Figure 2:
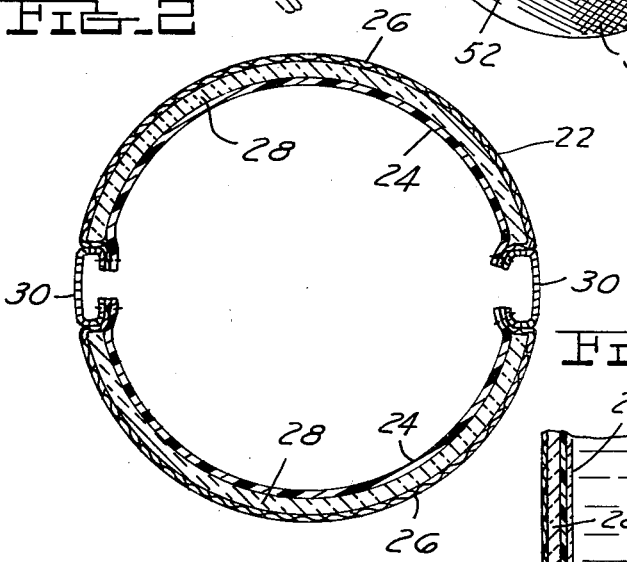
FIG. 2, a sectional view on line 2—2 of FIG. 1.
Figure 4:
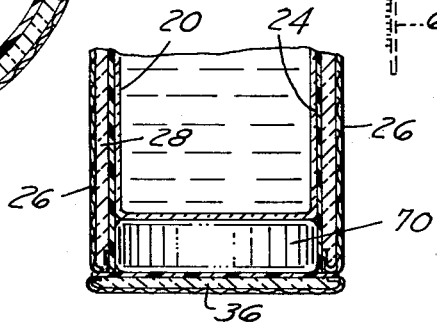
FIG. 4, a second modification with a refrigerant chamber.

REFERRING TO THE DRAWINGS, in FIG. 1, a bottle 20 is covered with a cylindrical bottle jacket 22 shown in cross-section in FIG. 2. A suitable porous insulation material which is flexible and preferably water resistant is utilized. This may include a liner 24, and outside sheath 26 with a filler material 28.

One and preferably two elastic inserts 30 are provided in the side of the cylindrical jacket, also formed of an insulating stretchable material extending longitudinally of the jacket and suitably joined by sewing or other means to the basic jacket material. These resilient inserts insure that the jacket will fit snug around a bottle and also adapt to varying size diameters of wine and soda bottles. A first end opening 32 at the top of the jacket allows the neck 34 of a bottle to extend out of the jacket. The second opening at the base of the jacket has, in FIG. 1, a disc-like cover 36, also of insulating material secured by an integral flap 38 and a slide fastener 40.

A holding strap 42 can be secured in the vertical seams of the jacket.

Figure 3:
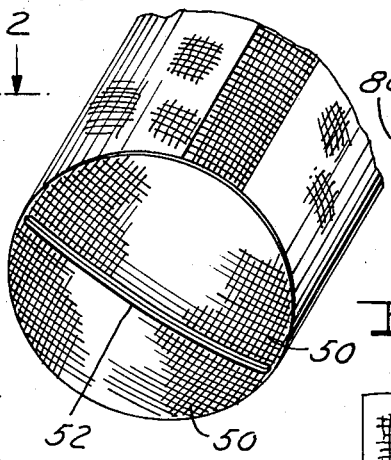
FIG. 3, a view of a modified bottle jacket bottom construction.
Figure 7:
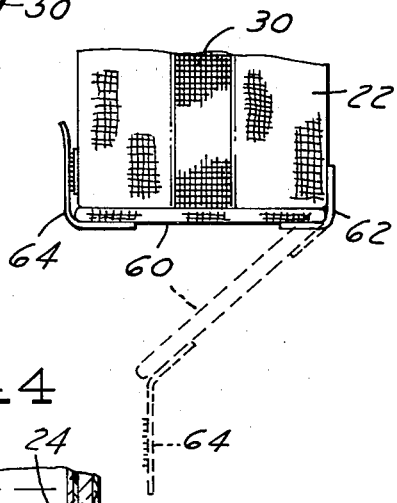
FIG. 7, another embodiment of a bottome construction.

In FIG. 3, a modified bottom formed of two semi-circular pieces in the form of pads 50 are sewn to the jacket walls and join on the diameter 52. These can be drawn back to allow the bottle to be inserted and removed. FIG. 7 illustrates still another bottom construction in the form of an insulating disc pad 60 hinged by a strip 62 at one side and removably fastened by a tab 64 using the hook and loop fabric fastener material.

In each case, the jacket may be dimensioned to leave a short cylindrical recess in the bottom to receive a flat disc-like ice pack unit 70. This can contain a refrigerant which, when frozen, retains its cold condition over a prolonged period.

Figure 5:
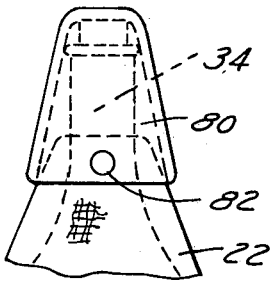
FIG. 5, a crown cap for a bottle jacket.
Figure 6:
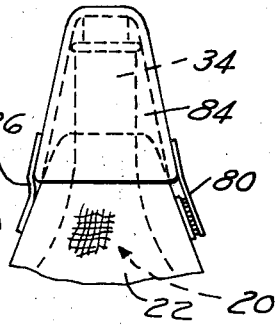
FIG. 6, a modified crown cap.

The top of the jacket can be closed by a crown cap 80 as shown in FIG. 5 which is fastened by snaps 82 on either side. In FIG. 6, the crown cap 84 is fastened by tabs 86 again using the loop-hook fabric fastener.

I claim:

1. An insulation pack for wine bottles and the like which comprises:

(a) a generally cylindrical jacket of flexible insulation material having a reduced neck portion open at a first end and an enlarged base portion open at a second end, (b) an elastic strip extending along the jacket in the direction of the axis thereof joined to edges of the jacket to allow adjustment to bottles of varying diameters, and (c) a base closure at said second end to close said jacket at the base end.

2. An insulation pack as defined in claim 1 in which said base closure comprises a circular disc of insulating material, and a zipper-type closure at the edges of said disc to secure the disc to said jacket.

3. An insulation pack as defined in claim 1 in which said base closure comprises semi-circular pads joined at the curved edges to said jacket, the diametrical edges of said pads lying adjacent each other in a closed position and being separable to permit a bottle to be inserted and removed from said jacket.

4. An insulation pack as defined in claim 1 in which said base closure comprises a circular insulating pad hinged at one point in its circumference to a wall of said jacket, and a releasable fastening tab to hold said pad over the opening at the second end of said jacket.

5. An insulation pack as defined in claim 1 in which a disc of refrigerant is retained at the base of said jacket by said base closure.

6. An insulation pack as defined in claim 1 in which a conical crown member is detachably secured to said jacket at said first end.

* * * * *